US007870902B2

(12) United States Patent
Misselbrook et al.

(10) Patent No.: US 7,870,902 B2
(45) Date of Patent: Jan. 18, 2011

(54) METHODS FOR ALLOWING MULTIPLE FRACTURES TO BE FORMED IN A SUBTERRANEAN FORMATION FROM AN OPEN HOLE WELL

(75) Inventors: John G. Misselbrook, Calgary (CA); David Ross, Magnolia, TX (US); Harold Brannon, Magnolia, TX (US); Alexander R. Crabtree, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 124 days.

(21) Appl. No.: 12/048,476

(22) Filed: Mar. 14, 2008

(65) Prior Publication Data

US 2009/0229821 A1 Sep. 17, 2009

(51) Int. Cl.
*E21B 43/26* (2006.01)

(52) U.S. Cl. ..... 166/281; 166/308.1

(58) Field of Classification Search ..... None
See application file for complete search history.

(56) References Cited

U.S. PATENT DOCUMENTS

| | | | |
|---|---|---|---|
| 2,803,306 | A | 8/1957 | Hower |
| 5,765,642 | A | 6/1998 | Surjaatmadja |
| 6,367,548 | B1 | 4/2002 | Purvis et al. |
| 6,394,184 | B2 | 5/2002 | Tolman et al. |
| 6,543,538 | B2 | 4/2003 | Tolman et al. |
| 6,782,948 | B2 | 8/2004 | Echols et al. |
| 6,907,936 | B2 | 6/2005 | Fehr et al. |
| 7,021,384 | B2 | 4/2006 | Themig |
| 7,108,067 | B2 | 9/2006 | Themig et al. |
| 7,134,505 | B2 | 11/2006 | Fehr et al. |
| 7,225,869 | B2 | 6/2007 | Willett et al. |
| 7,267,172 | B2 | 9/2007 | Hofman |
| 2005/0028975 | A1 * | 2/2005 | Al-Muraikhi ..... 166/271 |
| 2006/0090906 | A1 | 5/2006 | Themig |

OTHER PUBLICATIONS

"Packers Plus Introduction", Packers Plus Energy Services Inc., 3 pages.
Halliburton, "SurgiFrac® Service", webpage, 1 page, http://www.halliburton.com/ps/Default.aspx?navid=108&pageid=608&prodid=MSE%3a%3a1053531435407881.
Conn, Tim and Themig, Dan, "A Common Sense Approach to Intelligent Completions Through Improved Reliability and Lower Costs", Technical Publication, PROMORE 002, pp. 1-7.
Denney, Dennis, "Predicting Success of Horizontal Openhole Completions on the North Slope", JPT, Nov. 2006, pp. 47-49.

* cited by examiner

*Primary Examiner*—Zakiya W. Bates
(74) *Attorney, Agent, or Firm*—E. Randall Smith; Jones & Smith, LLP

(57) ABSTRACT

In some embodiments, a method of allowing a subterranean formation to be fractured from an open hole well bore section includes providing a removable coating across substantially the entire surface of the wall of the well bore section, selectively removing the coating at a desired first fracture initiation location and allowing the first fracture to be formed in the vicinity of the desired first fracture initiation location.

24 Claims, 5 Drawing Sheets

METHODS FOR ALLOWING MULTIPLE FRACTURES TO BE FORMED IN A SUBTERRANEAN FORMATION FROM AN OPEN HOLE WELL

FIELD OF THE INVENTION

The present invention relates generally to fracturing an open hole completed well or well section. In some embodiments, the present invention relates to methods for allowing multiple fractures to be formed in a subterranean formation from a non-vertical open hole well section.

BACKGROUND OF THE INVENTION

In fracturing subterranean formations from typical underground cased wells, the point of initiation of the fractures in the well may be relatively precisely located because the fracture can only initiate at the location where the casing has been perforated. However, it is sometimes necessary or desirable to fracture a subterranean formation from a non-cased, or open hole, completed well section. In those scenarios, one particular challenge is to be able to initiate the fracture at a desired location in the well.

In open hole scenarios, the fracture may occur at an unpredictable location in the well bore, such as may be due to the effects in the open hole caused by applied fluid pressure in the well. For example, when there is no casing or other fluidly impermeable barrier between pressurized well fluid and the exposed rock that forms the wall of the open hole, the rock could crack and fracture at an undesirable or intermediate location. The inability to control or pinpoint the fracture initiation location in open hole wells may be particularly important, for example, when attempting to form multiple fractures in a subterranean formation from a non-vertical section of an open hole well. As used herein, a "non-vertical" well may be a horizontal, lateral, inclined, deviated, directional or similar well.

Various techniques have been proposed for isolating the fracture initiation location in an uncemented lined well. For example, one current system utilizes one or more packer and sliding sleeve for segmenting a selected leg of a well bore. Using mechanical isolation, this equipment allows intervals of a horizontal well section to be segregated and stimulated separately. However, few techniques are believed to exist for open hole wells. One system utilizing a hydrojetting tool for jetting fluid through a nozzle at high pressures has been proposed for fracturing the formation where the fluid jet impacts the borehole wall. Positioning the jetting tool at the desired location allegedly results in the initiation of a fracture at that location.

Presently known techniques for isolating the fracture initiation location in an uncemented lined well may involve the use of specialized equipment that may be large and complex, costly to manufacture and utilize, and/or subject to sticking in the well and failure. While open hole completions typically require non-costly or complex equipment to be installed in the producing section of the well, the effectiveness and/or efficiency of proposed open hole fracturing techniques is questionable. For example, when the aforementioned hydrojetting tool is used to create a fracture, pressure must be maintained in the well bore annulus. Any weakness in the rock along the bore hole wall may result in the formation of an unexpected or undesirable fracture.

It should be understood, however, that the above-described examples, features and/or disadvantages are provided for illustrative purposes only and are not intended to limit the scope or subject matter of the claims of this patent or any patent or patent application claiming priority hereto. Thus, none of the appended claims or claims of any related patent or patent application should be limited by the above discussion or construed to address, include or exclude the cited examples, features and/or disadvantages, except and only to the extent as may be expressly stated in a particular claim. Further, the above exemplary disadvantages should be evaluated on a case-by-case basis.

Accordingly, there exists a need for methods useful for allowing the formation of fractures in a subterranean formation from an open hole portion of a well bore having one or more of the following attributes, capabilities or features: allows the formation of multiple fractures from a non-vertical open hole well portion; allows the formation of multiple distinct fractures from a non-vertical open hole well portion; allows the formation of multiple fractures from a horizontal open hole well portion; allows relatively precise location of fractures in an open hole well portion; utilizes an easily removable coating that is substantially impermeable, strong and/or coherent, essentially eliminates the effects of poroelasticity upon the formation under the coating regardless of the nature or type of hydrocarbons produced therefrom and in a wide range of temperatures, may be 100% soluble, or any combination thereof; protects each fracture from damage caused by subsequent formation fracturing; includes a non-damaging plug placed across the fracture and along a portion of the well bore proximate thereto to isolate the fracture from any subsequent fracturing operations; includes a proppant plug that does not substantially invade the fracture, does not impair conductivity of the fracture, is easy to clean out, or a combination thereof; may be implemented with the use of coiled tubing or a jointed pipe string; does not require additional, complex or costly equipment; is effective, cost efficient, reliable and/or easy to implement.

BRIEF SUMMARY OF THE INVENTION

In some embodiments, the present invention involves a method of allowing at least two fractures to be formed in a subterranean formation from a non-vertical, open hole section of an underground well bore. A removable coating is provided across substantially the entire surface of the wall of the well bore in the section of the well bore from which the fractures will be initiated. The coating is selectively removed at a desired first fracture initiation location in the well bore sufficient to allow a first fracture to be formed in the subterranean formation therefrom. The first fracture is allowed to be formed in the subterranean formation in the vicinity of the desired first fracture initiation location. A first plug is placed in the well bore around the first fracture initiation location after the first fracture is formed. The first plug shields the subterranean formation from fracturing at the first fracture location during subsequent fracturing from the open hole section and does not impair conductivity of the first fracture.

In many embodiments, the present invention involves a method of reducing the effects of linear poroelasticity on the subterranean formation forming the wall of an open hole well bore section sufficient to prevent the fracturing thereof during the fracturing of the subterranean formation from one or more adjacent locations in the open hole well bore. These embodiments includes providing a substantially thin, impermeable, strong and coherent coating across sub coating across substantially the entire surface of the wall of the open hole well bore. The coating is selectively removed from the open hole well bore wall at a desired first fracture initiation location in the open hole well bore without removing the coating from the remainder of the open hole well bore. A first fracture is allowed to be formed in the subterranean formation in the vicinity of the desired first fracture initiation location, while the remainder of the open hole well bore is shielded from fracturing by the coating.

In some embodiments, the present invention involves a method of initiating a fracture in a subterranean formation from a non-vertical open hole well bore section at a desired location for the production of hydrocarbons therefrom regardless of the type of hydrocarbons. These embodiments include providing an acid-soluble cement dispersion into the well bore section through a tubing that is disposed in the well bore. The acid-soluble cement dispersion is allowed to form a substantially impermeable, easily removable and entirely soluble coating across substantially the entire surface of the wall of the well bore section A coating remover is provided through the tubing to a desired first fracture initiation location in the well bore section proximate to the end of the tubing to remove the coating at that location without removing the coating from any other portion of the wall of the well bore section. The subterranean formation is allowed to be fractured in the vicinity of the first fracture initiation location. The fracture is isolated to prevent damage to the fracture during subsequent formation fracturing from the well bore section.

There are embodiments of the present invention involving a method of allowing multiple distinct fractures to be formed in a subterranean formation from a non-vertical open hole section of a well bore. These embodiments include inserting a tubing into the well bore and providing a coating-forming solution through the tubing into the well bore. The coating-forming solution is allowed to form a substantially impermeable coating on the wall of the well bore throughout the section of the well bore from which the fractures will be initiated.

A coating remover is provided through the tubing to a desired first fracture initiation location in the well bore to remove the coating at that location sufficient to allow a first fracture to be formed in the subterranean formation therefrom. The subterranean formation is fractured in the vicinity of the first fracture initiation location. A non-damaging proppant plug is placed across the first fracture initiation location and along a portion of the well bore adjacent thereto to isolate the first fracture from any subsequent fracturing operations. The tubing is moved to a desired second fracture initiation location. A coating remover is provided through the tubing to the second fracture initiation location in the well bore to remove the coating at that location sufficient to allow a second fracture to be formed in the subterranean formation therefrom. The subterranean formation is fractured in the vicinity of the second fracture initiation location.

Accordingly, the present invention includes features and advantages which are believed to enable it to advance open hole well completion technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

The following figures are part of the present specification, included to demonstrate certain aspects of preferred embodiments of the invention and referenced in the detailed description herein.

DETAILED DESCRIPTION OF PREFERRED EMBODIMENTS

Figure 1:
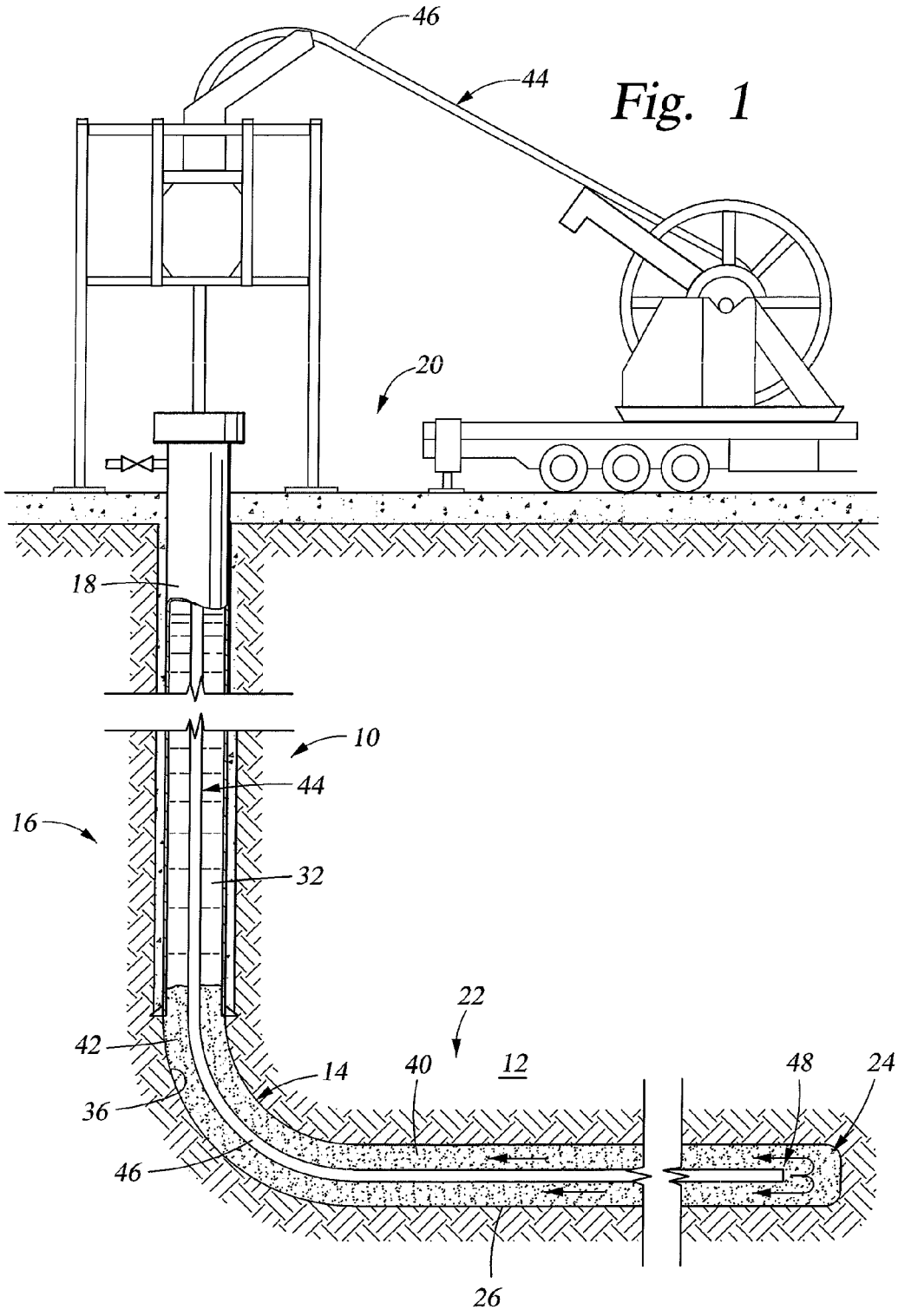
FIG. 1 is a schematic diagram of an example underground well having a non-vertical section wherein a coating will be provided in accordance with an embodiment of the present invention.

Characteristics and advantages of the present invention and additional features and benefits will be readily apparent to those skilled in the art upon consideration of the following detailed description of preferred embodiments of the claimed invention and referring to the accompanying figures. It should be understood that the description herein and appended drawings, being of preferred embodiments, are not intended to limit the appended claims or the claims of any patent or patent application claiming priority to this application. On the contrary, the intention is to cover all modifications, equivalents and alternatives falling within the spirit and scope of the claims. Many changes may be made to the particular embodiments and details disclosed herein without departing from such spirit and scope.

In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean the invention of every possible embodiment of the invention or any particular claim or claims. Thus, the subject matter of each such reference should not be considered as necessary for, or part of, every embodiment of the invention or any particular claim(s) merely because of such reference. Also, it should be noted that reference herein and in the appended claims to components and/or aspects in a singular tense does not necessarily limit the present invention to only one such component or aspect, but should be interpreted generally to mean one or more, as may be suitable and desirable in each particular instance.

A method of allowing multiple fractures to be formed in a subterranean formation for hydrocarbon recovery from an open hole completed well section in accordance with the present invention will now be described with reference to the well 10 of FIG. 1. The illustrated well 10 includes a well bore 14 with a vertical portion 16 having a casing 18 therein, and a non-vertical portion 22 that is open hole. In this example, the section 26 of the well 10, from which the subterranean formation 12 is to be fractured (the "fracture section") is in the non-vertical portion 22, which extends to the toe 24 of the well bore 14. As used herein, the term "fracture section" and variations thereof refers to the section or portion of the well or well bore from which the formation is intended to be fractured. As shown, the fracture section 26 of the illustrated well 10 (see also FIG. 6) is the horizontal, open hole portion. However, it should be understood that the present invention is not limited to the example of FIG. 1.

In accordance with an embodiment of the present invention, a removable coating 30 (e.g. FIG. 2) is provided across the wall 36 of the well bore 14 at the fracture section 26. As used herein the term "coating" and variations thereof means one or more at least substantially fluidly impermeable layer, skin, filter-cake, sheathe, or the like provided on the exposed surface of the subterranean formation that forms the wall of the well bore. The coating may have any suitable composition, thickness, coverage across the well bore wall and other properties, as long as it is (i) removable and (ii) sufficient to prevent failure or fracturing of the formation along the coated section of the wall due to fluid pressure that may be applied in the well to fracture the formation from an adjacent non-coated location in the well bore. Such a coating may sometimes be referred to herein as being "substantially impermeable" and provided across "substantially the entire surface" of the wall of the fracture section of the well bore. In some instances, the coating is substantially impermeable, strong and coherent, essentially eliminates the effects of linear poroelasticity on the formation under the coating regardless of the nature or type of hydrocarbons produced therefrom and in a wide range of temperatures, may be easily and quickly removed, may be 100% soluble or a combination thereof.

Figure 2:
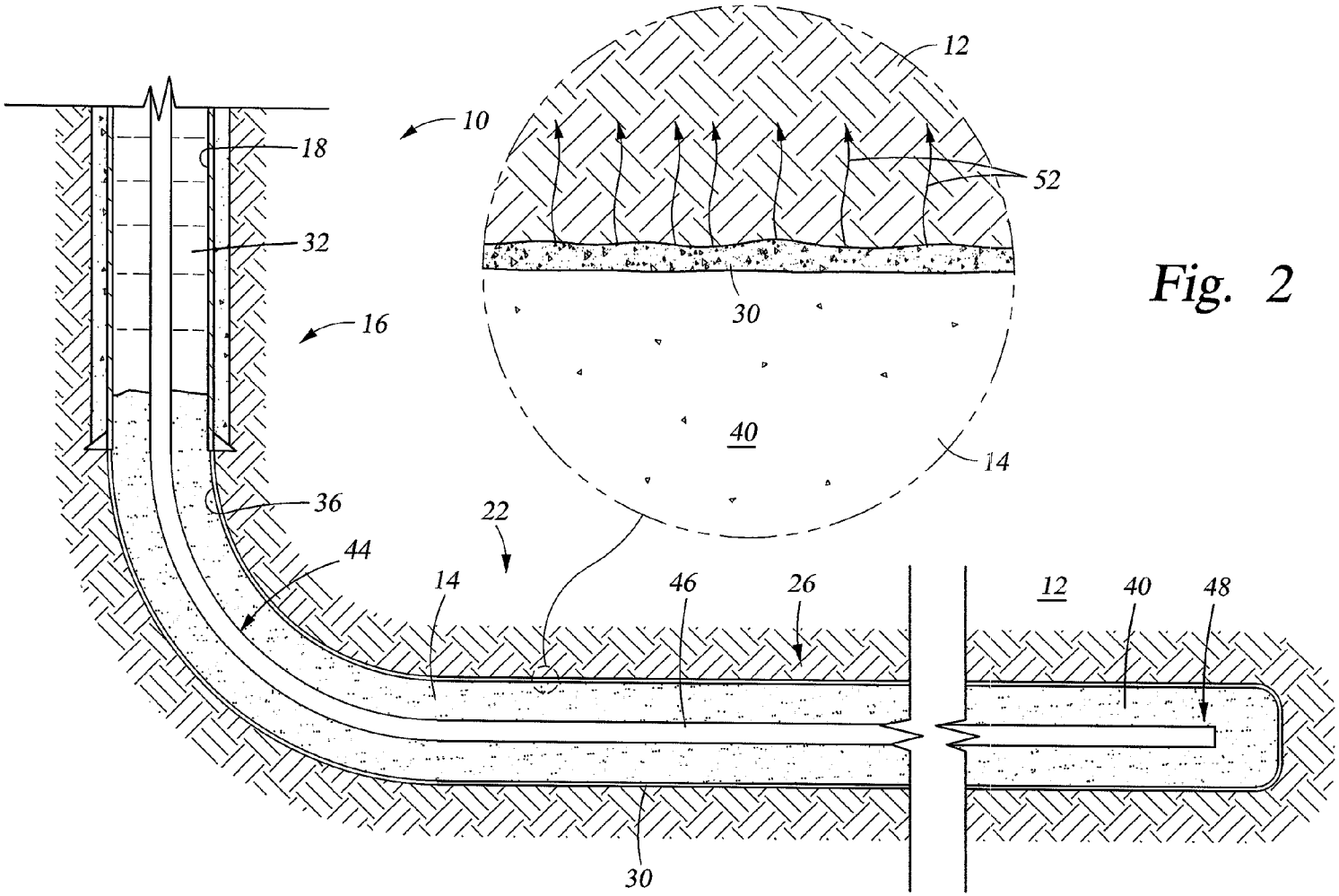
FIG. 2 illustrates an exemplary coating provided in a non-vertical section of the well of FIG. 1 in accordance with an embodiment of the present invention.

Referring to FIG. 2, in the present embodiment, the coating 30 is sufficiently thin so that it does not fill, block or substantially narrow the well bore 14. For example, the coating 30 may be thin enough not to block or hinder the passage through the well bore 14 of a coiled tubing, jointed pipe string and/or other equipment used in well completion. Such a coating 30 may sometimes be referred to herein as a "substantially thin" coating. In some applications of this embodiment, the coating 30 may have a thickness of less than one millimeter (1 mm). However, in other applications, the coating 30 may have a thickness greater than 1 mm.

As indicated above, the coating 30 may include any suitable components. For example, the coating 30 may include particulate resin, cement, wax, gilsonite, or other acid or oil soluble materials. Various materials that may be suitable for use as the coating 30, depending upon the particular application, may be found in U.S. Pat. No. 6,367,548 to Purvis et al, issued on Apr. 9, 2002 and owned by the present assignee, as well as patents incorporated by reference therein, including U.S. Pat. No. 2,803,306 issued in August 1957 to Hower, the entire specifications of which are all hereby incorporated herein by reference in their entireties.

Still referring to FIG. 2, one particular example coating 30 includes an acid-soluble material that may be delivered in one or more fluid. Such a mixture including acid-soluble material and fluid is sometimes referred to herein as the dispersion 40. In the present embodiment, a small quantity of fine or microfine acid-soluble cement, such as presently available MagneBlock™ cement base material commercially sold by the current assignee hereof, BJ Services Company, is mixed into water to form a dilute cement-based dispersion 40. The particle size of the exemplary cement is small enough to remain suspended in the water so it does not completely harden or set-up in the well bore 14 during use, but is still capable of settling against the well bore wall 36 to form the coating 30 thereon. One or more suitable chemical additives may be included in the dispersion 40 to assist in keeping the cement particles suspended or for any other desired purpose.

The coating 30 may be delivered into the well bore 14 in any suitable manner. In the present embodiment, referring back to FIG. 1, a cement-based dispersion 40 is delivered through a tubing 44 in the well bore 14 to form a coating 30 at the fracture section 26 thereof. Any suitable type of tubing 44 may be used, such as a jointed "frac" string or coiled-tubing 46. Likewise, the tubing 44 may have any suitable size, such as 2⅞ inch diameter coiled tubing. In the example shown, the front end 48 of the coiled tubing 46 is initially positioned at the far end of the fracture section 26 proximate to the toe 24 of the well bore 14. The dispersion 40 is pumped through the coiled tubing 36 into the well bore 14 in the vicinity of the toe 24 thereof to preferably completely fill the fracture section 26. Any water 32 (or other fluid) in the fracture section 26 will be pushed back by the dispersion 40 into a non-fracture section of the well bore 14 or out of the well 10.

Referring back to FIG. 2, after the dispersion 40 has generally filled the fracture section 26, the well 10 is shut-in at the surface 20. More dispersion 40 may be pressure fed into the well bore 14, causing fluid in the dispersion 40 to leak away (e.g. arrows 52) into semi-permeable rock forming the wall 36 of the well bore 14. As the cement particles in the dispersion 40 dehydrate, some of them may also leak into the rock, while others will bridge out and build-up against the wall 36 to form the coating 30 thereon.

In some instances, it may be desirable or necessary to mildly increase the fluid pressure in the fracture section 26 to build up a sufficient coating 30 around the entire circumference of the wall 36 in the fracture section 26. In the present embodiment, as the pressure increases, leakage of the dispersion 40 into the subterranean formation 12 will eventually decrease and the thickness of the coating 30 will increase. The specific pressure increase and pressurization duration may depend upon one or more factors, such as the composition of the coating 30 and/or subterranean formation 12, the size of the well 10, size of the tubing 44 and/or other variables.

In some applications, to ensure a substantially thin coating 30, it may be necessary to reduce or stop the application of fluid pressure in the fracture section 26. In the present embodiment, after sufficient time has elapsed to allow the coating 30 to form as desired, the remaining dispersion 40 may be displaced out of the fracture section 26 of the well 10 (e.g. FIG. 3). For example, the valve(s) controlling the flow of fluid through the annulus 42 formed between the tubing 44 and well bore wall 36 may be opened and water 32 (or other desirable fluid) pumped through the coiled tubing 46 to the toe 24 of the well bore 14 to push the remaining dispersion 40 in the fracture section 26 back into the vertical portion 16 of the well 10. In such instance, the dispersion 40 will principally reside in the casing 18, such as steel pipe, where it is generally unable to further leak-off or harden. The dispersion 40 will be available for future use in the fracture section 26, if necessary, such as to reestablish the coating 30 at certain locations. Any fluid, such as water, in the well 10 above the dispersion 40 may be forced up or out of the well 10. The water 32 or other fluid pumped into the well bore 14 is preferably neutral so that it will not destabilize the coating 30 formed in the fracture section 26.

However, the particular sequence and methodology for delivering the coating 30 or dispersion 40 into the fracture section 26 may vary depending upon one or more factor, such as the existence of fluid or other material in the well bore, type of drilling fluid used, formation permeability, etc. For example, in some instances, if the well bore 14 initially contains any unneeded or undesirable fluid, such as drilling mud or completion fluid, such fluid may first be displaced out of the well 10 or the fracture section 26 before providing the coating 30 or dispersion 40. For example, water may be pumped through the tubing 46 into the well bore 14 to fill at least the fracture section 26 and displace the undesirable fluid into another section of the well bore 14 or entirely out of the well 10.

For another example, it may necessary or desirable to remove existing drilling fluid filter cake or other material (not shown) formed on the wall 36 of the fracture section 26 before providing the coating 30. Such material may interfere with the formation or effectiveness of the coating 30, inhibit the ability of the dispersion 40 to adhere to the wall 36 or cause one or more other problems. As an example, the tubing 44 may be positioned proximate to the toe 24 of the well bore 14. While pulling the tubing 44 up through the fracture section 26, a fluid capable of washing off or removing the filter cake (or other material) from the wall 36 is pumped through the tubing 44 into the well bore 14. The pre-wash fluid may have any suitable composition (water, additives, solvents, other components) depending upon the well 10, type of drilling mud utilized or other factors. After such pre-washing, the dispersion 40 may be dispensed into the well bore 14 through the tubing 44 at or near the top of the fracture section 26, such as at the bottom of the casing 18, and thereafter as the tubing 44 is run back into the well bore 14 toward the toe 24.

There may be other instances where it is desirable or necessary to circulate the dispersion 40 in the well bore 14 at the near end of the fracture section 26 or proximate to the casing 18, and thereafter as the tubing 44 is run into the well to the toe 24. For example, this technique may be useful when it is difficult to pre-position the tubing 44 at the toe 24 of the well, such as when the tubing 44 becomes differentially stuck in the well bore 14 at some intermediate location. In some embodiment, the dispersion 40 or other coating 30 may instead be pumped or otherwise delivered to the fracture section 26 of the well 10 from the surface 20 through the annulus 42 and the well bore fluids returned up through the tubing 44.

Figure 3:
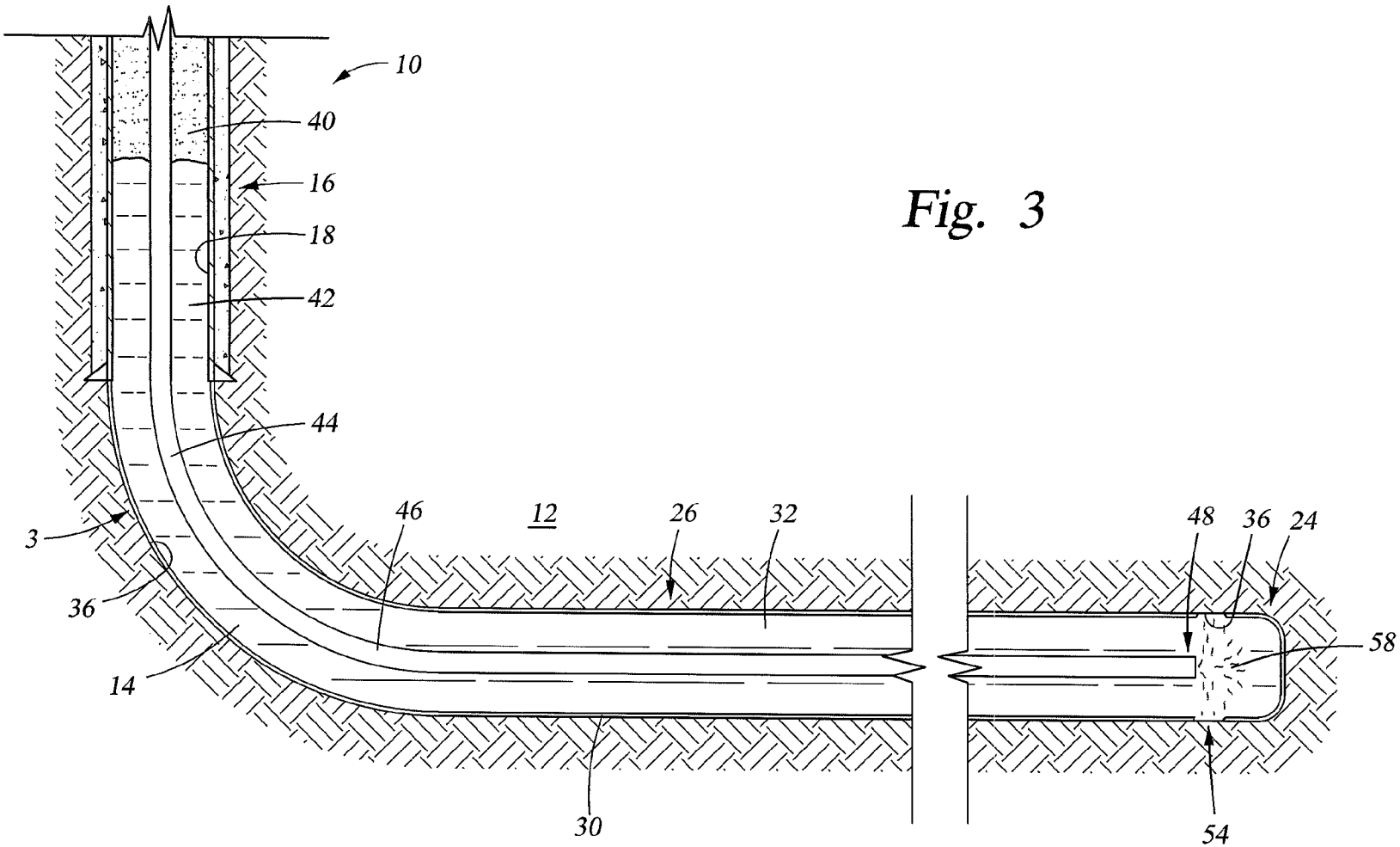
FIG. 3 illustrates the removal, at a first fracture initiation location, of part of an exemplary coating provided in a non-vertical section of the well of FIG. 1 in accordance with an embodiment of the present invention.

Referring now to FIG. 3, in the present embodiment, the coating 30 is selectively removed from the fracture section 26 at a desired location of initiation 54 of a first fracture sufficient to allow a first fracture to be formed in the subterranean formation 12. Any suitable technique and/or coating remover may be used to remove the coating 30 at the first fracture initiation location 54. For example, the coating remover may be a mechanical device (not shown) for selectively removing the coating 30. In other examples, a fluid-delivered coating remover may be provided into the well bore 14 through the tubing 44 or the annulus 42 to the first fracture initiation location 54.

In the illustrated embodiment, the desired location of initiation 54 of the first fracture is proximate to the toe 24 of the well bore 14. After the necessary volume of water 32 or other neutral fluid is pumped into the illustrated well bore 14 to displace the remaining dispersion 40 out of the fracture section 26, a cement-dissolving acid 58 (or other suitable substance) is provided through the coiled tubing 46 to the first fracture initiation location 54. For example, the water 32 or other neutral fluid may be followed by a lead slug of acid 58 and the pad of the planned fracture treatment.

The acid 58 (or other suitable substance) is provided to dissolve the exemplary coating 30 from the well bore wall 36 at that location, but without at least substantially dissolving the coating 30 at any other location in the well bore 14 or the fracture section 26 thereof. In the present embodiment, a minimal quantity of acid 58 capable of dissolving the coating 30 at (only) the first fracture initiation location 54 in a reasonable time period may be provided. The quantity of acid 58 (or other substance) and the time allowed to remove the coating 30 may depend upon one or more variable, such as the composition of the coating 30 and type of acid 58, thickness of the coating 30 and/or one or more well properties. In some applications, the time allowed for acidizing the first fracture initiation location 54 may be approximately ten minutes, while in other applications, it may be more or less than ten minutes.

For example, if the tubing 44 has an internal volume of thirty barrels of fluid, after twenty-nine barrels of neutral fluid 32 are pumped through the tubing 44 into the fracture section 26, the annulus 42 is shut-in and a single barrel of acid 58 is squeezed out the end 48 of the tubing 44. As the acid 58 is displaced into the closed annulus 42, the acid 58 will remain locally near the end 48 of the tubing 44 and not migrate through the fracture section 26. In some instances, it may be desirable to apply a slight positive pressure in the annulus 42 from the surface as the acid 58 is displaced out of the tubing 44 to assist in inhibiting the uncontrolled movement of the acid 58 in the well bore 14 and focusing the acid 58 to react through the coating 30 at the desired location.

It should be noted that the acid 58 (or other suitable substance) may have one or more additional benefit. For example, as the acid 58 dissolves the coating 30 at the desired fracture initiation location, the acid 58 may also react with the formation 12. If the dispersion 40 leaked into the formation 12 or another filter cake was formed inside the formation 12, the acid 58 may dissolve it and assist in weakening the rock in advance of the fracturing treatment and promoting formation breakdown.

Figure 4:
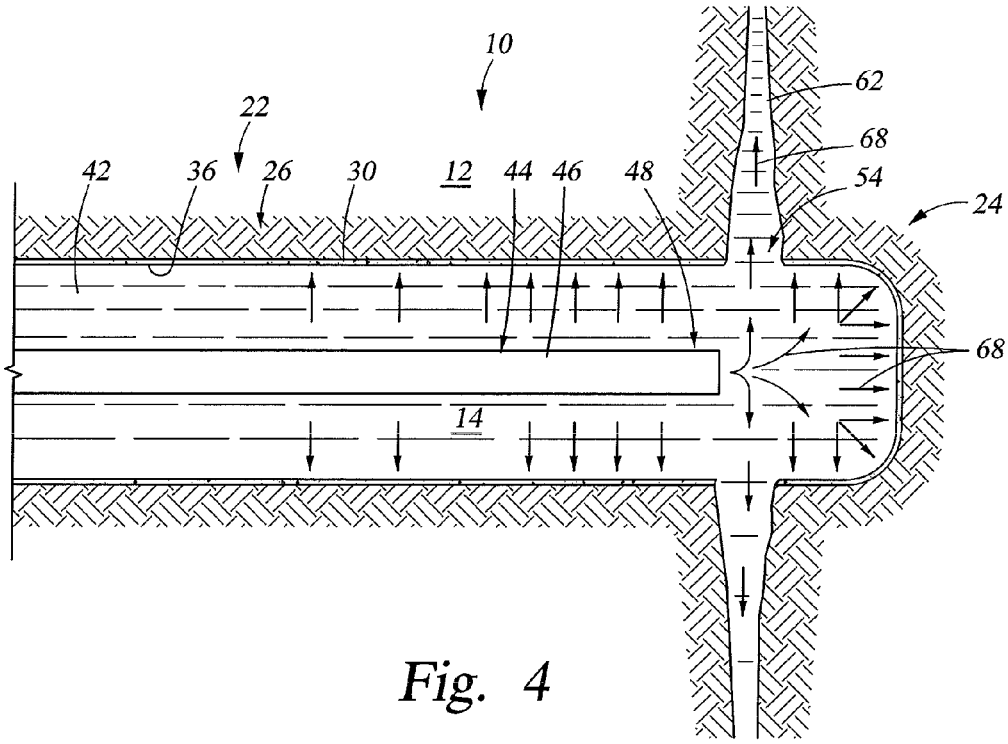
FIG. 4 illustrates the initiation of a fracture at a first fracture initiation location in a non-vertical section of the well of FIG. 1 in accordance with an embodiment of the present invention.

After the illustrated coating 30 is sufficiently removed at the desired first fraction initiation location 54, a first fracture is allowed to be formed at that location. Any suitable fracturing technique may be used. In the embodiment of FIG. 4, hydraulic fracturing, as is or becomes know, is used to form the fractures by pumping hydraulic fracturing fluid 68 through the tubing 44 into the well bore 14 proximate to the first fracture initiation location 54. In other embodiments, hydraulic fracturing fluid 68 may instead be delivered to the first fracture initiation location 54 through the annulus 42. In yet other embodiments hydraulic fracturing fluid 68 may be provided to the first fracture initiation location 54 through both the tubing 44 and the annulus 42. For example, hydraulic fracturing fluid including proppant may be delivered to the first fracture initiation location 54 through the tubing 44 and hydraulic fracturing fluid not including proppant may be provided through the annulus 42, such as to avoid removal of the coating 30 in the fracture section 26 other than at the first fracture initiation location 54.

The adjacent coated subterranean formation forming the bore hole wall 36 in the remainder of the fracture section 26 of the well bore 14 should be stronger than the non-coated portion (at the first fracture initiation location 54) and unlikely to fail under the hydraulic pressure needed to fracture the non-coated portion, allowing precise location of the initiation of the first fracture. For example, the non-coated portion of the formation 12 (forming the bore hole wall 36 at the first fracture location 54) should be subject to the effects of linear poroelastic stress, while the adjacent coated formation 12 should remain substantially isolated therefrom. Under the theory of linear poroelasticity, which describes the mechanical effect of adding or removing fluid from rock pores, an increase in fluid pressure on a porous rock induces dilation (e.g. cracking) of the rock. Because of the suitably impermeable, strong and coherent nature of the coating 30, the effect of linear poroelasticity on the coated parts of the fracture section 26 are preferably reduced or eliminated, isolating those coated areas from cracking or fracture caused by the applied pressure, possibly intensifying stress placed on the non-coated area. However, the present invention is not limited to reducing or eliminating linear poroelastic stress on the coated parts of the bore hole wall 36.

Still referring to the embodiment of FIG. 4, the rock pores at the first fracture initiation location 54 should preferentially fail and crack. When the formation 12 cracks, the well pressure should typically drop at the breakdown pressure of the rock. If desired or necessary, as fracture fluid 68 leaks off into the crack, fluid pressure may be increased to cause the crack to open and propagate, forming the first fracture 62. The magnitude of applied fluid pressure in the fracture section 26 of the well bore 14 and duration of pressurization sufficient to crack the formation 12 at the first fracture initiation location 54 and not crack the formation throughout the remainder of the fracture section 26 of the well bore 14 may, in any particular instance, depend upon one or more variables, such as one or more formation properties, well bore size, tubing size, etc.

Figure 5:
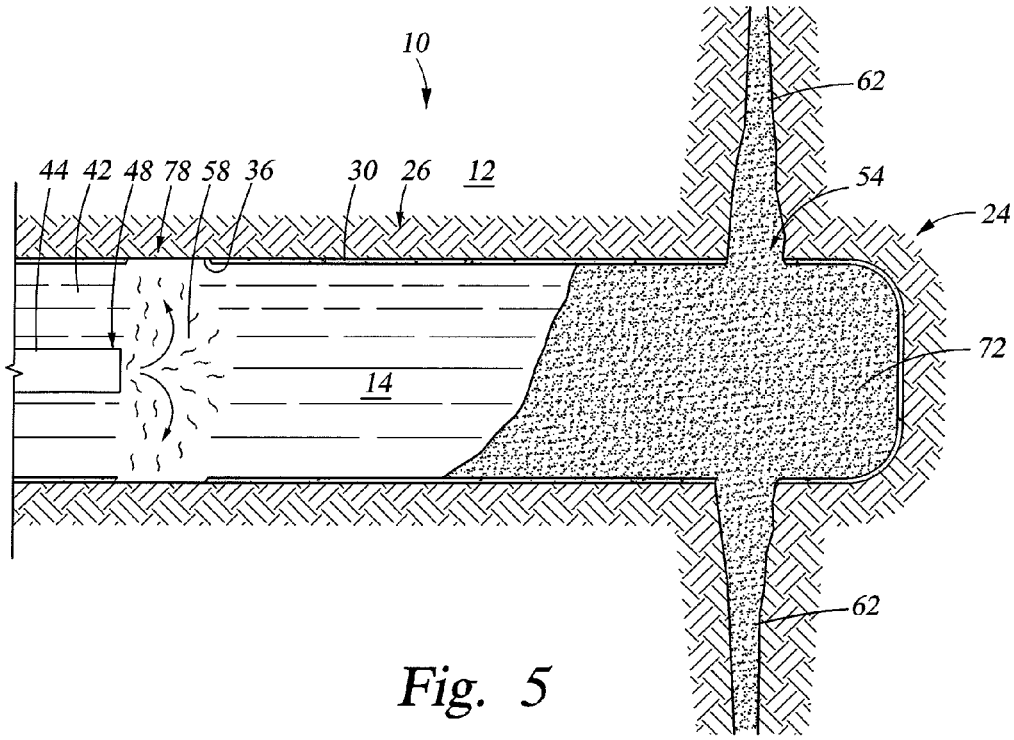
FIG. 5 illustrates the placement of an example proppant isolation plug across the first fracture and removal, at a second fracture initiation location, of part of an exemplary coating provided in a non-vertical section of the well of FIG. 1 in accordance with an embodiment of the present invention.

In the present embodiment, as the first fracture 62 is formed, a proppant or other material or mixture is provided to prop the fracture 62 open, as is or becomes known. As the fracture 62 fills with the proppant (or other suitable material or mixture), a removable plug 72 (e.g. FIG. 5) of the same proppant or a different proppant, sand, or other suitable material or mixture, is provided in the well bore 14 around the first fracture initiation location 54 and proximate thereto to shield it from fracturing during the subsequent fracturing operations and/or avoid damage to the first fracture 62. Any suitable removable plugging materials may be used for the plug 72, such as proppant, lightweight proppant or sand, etc. In the present embodiment, the plug 72 includes plugging material that does not invade the propped fracture 62 or impair fracture conductivity, and is easy to clean out. For example, as the fracture 62 fills with proppant, the pump rate of the proppant may be decreased and the tubing 44 pulled up the well 10, leaving a plug 72 of proppant in the well bore 14 to cover the treated zone.

Figure 6:
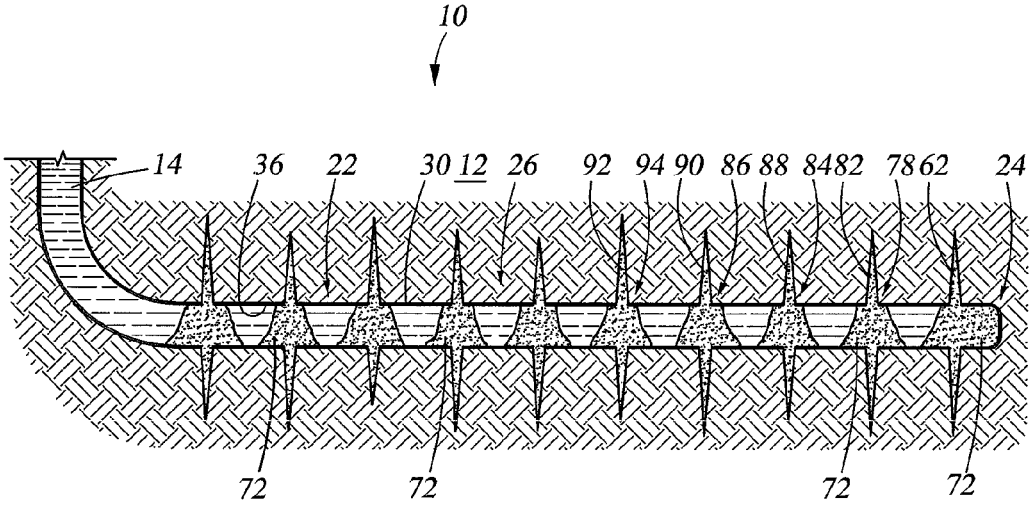
FIG. 6 illustrates the exemplary well of FIG. 1 having multiple fractures initiated from a non-vertical section thereof in accordance with an embodiment of the present invention.

After the first fracture is formed, additional fractures may be formed at different locations in the fracture section 26 of the well bore 14, if desired. For example, as shown in FIG. 6, a second fracture 82 may be formed at a second fracture initiation location 78 after the coating 30 is removed therefrom, followed by a third fracture 88 at a third fracture initiation location 84, a fourth fracture 90 at a fourth fracture initiation location 86, a fifth fracture 92 at a fifth fracture initiation location 94 and so on.

In the present embodiment, referring back to FIG. 5, the end 48 of the tubing 44 is moved to a second fracture initiation location 78 up-hole from the first fracture 62, and the previously described process is repeated. For example, the coating 30 may be selectively removed from the second fracture initiation location 78 sufficient to allow a fracture to be formed in the subterranean formation 12. If desired, a cement-dissolving acid 58 (or other suitable substance) may be provided through the tubing 44, such as described above, to dissolve the coating 30 from the well bore wall 36 at the second fracture initiation location 78, but without at least substantially dissolving the coating 30 at any other location in the well bore 14.

Figure 7:
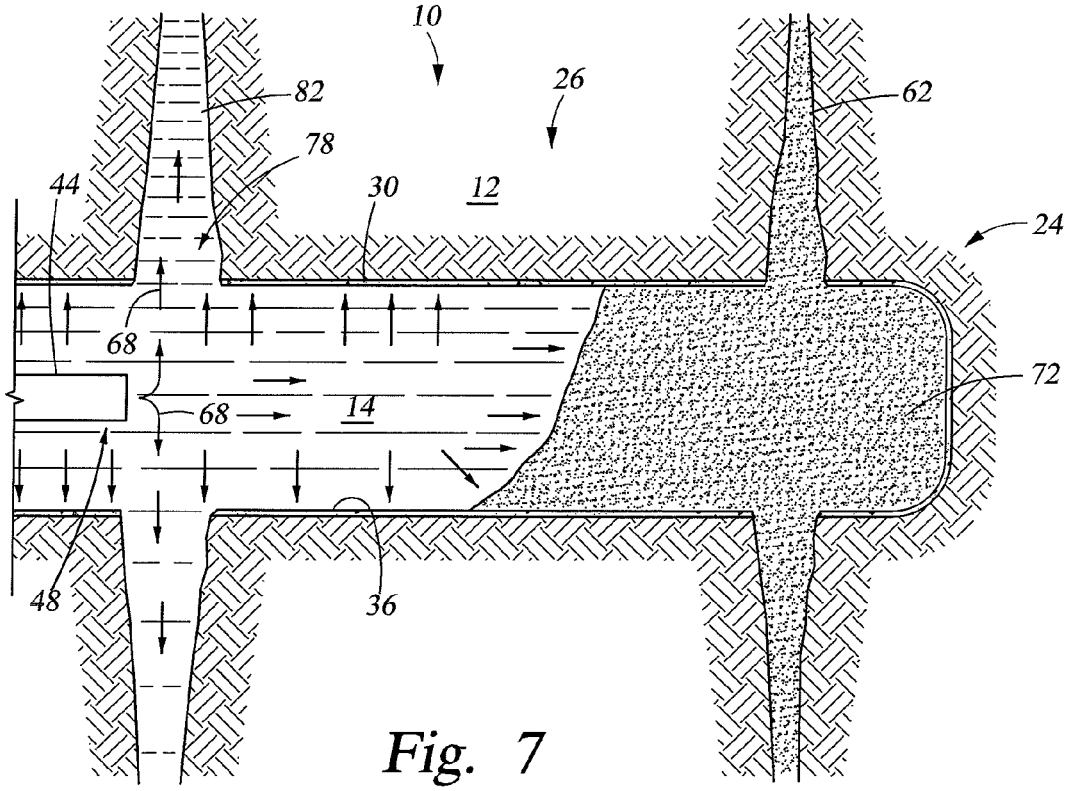
FIG. 7 illustrates the initiation of a fracture at a second fracture initiation location in a non-vertical section of the well of FIG. 1 in accordance with an embodiment of the present invention.

Still in accordance with the present embodiment, referring to FIG. 7, after the coating 30 is removed from the second fracture initiation location 78, the second fracture 82 may be formed in the formation 12 at the second fracture initiation location 78. For example, hydraulic fracturing fluid 68 may be pumped through the tubing 44 into the well bore 14 proximate to the second fracture initiation location 78 sufficient to crack and fracture the formation 12 at that location without fracturing the formation at any coated location of the well bore 14, such as described above with respect to the first fracture initiation location 54. The plug 72 provided in the well bore 14 at the first fracture initiation location 54 isolates that area from being affected by any increase in applied fluid pressure in the well bore 14 during fracturing/treatment of the second fracture 82.

After the second fracture 82 is initiated or formed, the plug 72 in the well bore 14 at the first fracture 62 and/or the coating 30 between the first and second fractures 62, 82 may be partially or fully removed, if desired. Any suitable technique may be used, as long as the coating 30 on the well bore wall 36 up-hole of the second fracture initiation location 78 is not removed if additional up-hole fracturing is desired. However, the plug 72 and coating 30 may instead be removed after all the desired fractures are formed. Also if desired, a plug 72 (e.g. FIG. 6) may then be provided in the well bore 14 around the second fracture 82, such as described above with respect to the first fracture 62.

In this embodiment, the same process may be repeated multiple times to create as many distinct fractures in the formation 12 from the fracture section 26 of the well bore 14 as is practical, reasonable and/or desired. In the embodiment of FIG. 6, a total of ten successively placed exemplary fractures are shown, each fracture formed at a higher portion of the fracture section 26 of the well bore 14 from the previously placed fracture. In one example, each fracture formed in a fracture section 26 having a rough estimated length of 10,000 feet may be located in the range of 100-1,000 feet up-hole of the previously formed fracture.

If desired, after all the desired fractures are formed, any remaining coating 30 and plugs 72 in the well bore 14 may be removed using any suitable technique. For example, a suitable pressurized acid mixture (not shown) may be pumped through the tubing 44 while moving the tubing forward in the well bore 14 toward the toe 24 from the last formed fracture initiation location, removing the remaining coating 30 from the well bore wall 36 and pushing it, along with material forming any plugs 72, up through the annulus 42 and out of the well 10. Thereafter, the well 10 may be produced as desired.

The methods described above and claimed herein and any other methods which may fall within the scope of the appended claims can be performed in any desired suitable order and are not necessarily limited to the sequence described herein or as may be listed in the appended claims. Further, the methods of the present invention do not necessarily require use of the particular embodiments shown and described in the present application, but are equally applicable with any other suitable structure, form and configuration of components.

While preferred embodiments of the invention have been shown and described, many variations, modifications and/or changes of the methods and system of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the invention and the appended claims should not be limited to the embodiments described and shown herein.

The invention claimed is:

1. A method of allowing at least two fractures to be formed in a subterranean formation from a non-vertical, open hole section of an underground well bore, the method comprising:

providing a removable coating across substantially the entire surface of the wall of the well bore in the section of the well bore from which the at least two fractures will be initiated;

selectively removing the coating from the well bore wall at a desired first fracture initiation location in the well bore sufficient to allow a first fracture to be formed in the subterranean formation therefrom;

allowing the first fracture to be formed in the subterranean formation in the vicinity of the desired first fracture initiation location, wherein the remainder of the section of the well bore from which the at least two fractures will be initiated is shielded from fracturing by the coating;

placing a first plug in the well bore around the first fracture initiation location after the first fracture is, formed, the first plug shielding the subterranean formation from fracturing at the first fracture initiation location during subsequent fracturing of the subterranean formation from the open hole section, the first plug not impairing conductivity of the first fracture;

selectively removing the coating from the well bore wall at a desired second fracture initiation location in the well bore sufficient to allow a second fracture to be formed in the subterranean formation therefrom; and allowing the second fracture to be formed in the subterranean formation in the vicinity of the desired second fracture initiation location, wherein the remainder of the section of the well bore from which the at least two fractures is initiated is shielded from fracturing.

2. The method of claim 1, wherein the first plug comprises proppant material.

3. The method of claim 2, further including at least partially removing the first plug from the section of the well bore from which the at least two fractures are initiated after the second fracture is formed.

4. The method of claim 3, further including removing the coating from the well bore wall between the first and second fracture initiation locations after the second fracture is formed.

5. The method of claim 1, further including placing a second plug in the well bore around the second fracture initiation location after the second fracture is formed, the second plug shielding the subterranean formation from fracturing at the first and second fracture initiation locations during fracturing of the subterranean formation at subsequent desired fracture initiation locations.

6. The method of claim 5, further including successively selectively removing the coating from the well bore wall at multiple additional desired fracture initiation locations sufficient, in each respective instance, to allow fracturing of the subterranean formation from that fracture initiation location and without removing the coating from the remainder of the section of the well bore from which the at least two fractures will be initiated, allowing a distinct fracture to be formed in the subterranean formation in the vicinity of each such subsequent fracture initiation location, respectively, and after each fracture is formed, placing a plug in the well bore around the fracture initiation location, the plug shielding the subterranean formation from fracturing at the fracture initiation location during subsequent formation fracturing from the open hole section.

7. The method of claim 6, further including removing the coating from the well bore wall after all of the fractures are formed in the subterranean formation.

8. The method of claim 1, wherein the coating is sufficient to eliminate the effects of poroelasticity on the formation under the coating regardless of the nature or type of hydrocarbons produced therefrom.

9. The method of claim 8, wherein the non-vertical, open hole section of the underground well bore is horizontal.

10. The method of claim 8, wherein the coating is provided through at least one among a coiled tubing and a jointed pipe string.

11. The method of claim 10, further including providing an acid-soluble cement-based dispersion through at least one among a coiled tubing and a jointed pipe string into the well bore to form the coating.

12. The method of claim 11, further including providing acid through at least one among a coiled tubing and a jointed pipe string into the well bore at each successive desired fracture initiation location to dissolve the coating thereabout.

13. The method of claim 12, further including forming the first and second fractures by hydraulic fracturing with the use of hydraulic fracturing fluid provided through at least one among a coiled tubing and a jointed pipe string.

14. The method of claim 12, further including forming the first and second fractures by hydraulic fracturing with the use of hydraulic fracturing fluid provided through an annulus formed between the wall of the well bore and at least one among a coiled tubing and a jointed pipe string.

15. The method of claim 14, further including forming the first and second fractures by hydraulic fracturing with the use of hydraulic fracturing fluid also provided through at least one among a coiled tubing and a jointed pipe string.

16. A method of reducing the effects of linear poroelasticity on the subterranean formation forming the wall of an open hole well bore section sufficient to prevent the fracturing thereof during the fracturing of the subterranean formation from one or more adjacent locations in the open hole well bore, the method comprising:

providing a substantially thin, impermeable, strong and coherent coating across substantially the entire surface of the wall of the open hole well bore;

selectively removing the substantially thin coating from the open hole well bore wall at a desired first fracture initiation location in the open hole well bore without removing the substantially thin coating from the remainder of the open hole well bore; and allowing a first fracture to be formed in the subterranean formation in the vicinity of the desired first fracture initiation location, wherein the remainder of the open hole well bore is shielded by the substantially thin coating from the effects of linear poroelasticity sufficient to prevent fracturing of the subterranean formation therefrom.

17. The method of claim 16, further including selectively removing the substantially thin coating from the open hole well bore wall at a desired second fracture initiation location in the open hole well bore without removing the substantially thin coating from the remainder of the open hole well bore; and allowing a second fracture to be formed in the subterranean formation in the vicinity of the desired second fracture initiation location, wherein the remainder of the open hole well bore is shielded from fracturing by the substantially thin coating.

18. The method of claim 17, wherein the substantially thin coating is provided through at least one among a coiled tubing and a jointed pipe string.

19. The method of claim 18, wherein the open hole well bore is generally horizontally oriented.

20. A method of initiating a fracture in a subterranean formation from a non-vertical open hole well bore section at a desired location for the production of hydrocarbons therefrom regardless of the type of hydrocarbons, the method comprising:

providing an acid-soluble cement dispersion into the well bore section through a tubing that is disposed in the well bore;

allowing the acid-soluble cement dispersion to form a substantially impermeable, easily removable, entirely soluble coating across substantially the entire surface of the wall of the well bore section;

providing a coating remover through the tubing to a desired first fracture initiation location in the well bore section proximate to the end of the tubing to remove the coating at that location without removing the coating from any other portion of the wall of the well bore section;

allowing the subterranean formation to be fractured in the vicinity of the first fracture initiation location; and isolating the fracture formed in the subterranean formation to prevent damage to the fracture during subsequent formation fracturing from the well bore section.

21. The method of claim 20, further including placing a first plug in the well bore section around the first fracture initiation location after the first fracture is formed, the first plug shielding the subterranean formation from fracturing in the vicinity of at the first fracture initiation location during any subsequent fracturing of the subterranean formation from other locations in the well bore section, moving the end of the tubing to a desired second fracture initiation location up-hole of the first fracture initiation location, providing a coating remover through the tubing to the desired second fracture initiation location in the well bore section proximate to the end of the tubing to remove the coating at that location; and allowing the subterranean formation to be fractured in the vicinity of the second fracture initiation location, wherein the remainder of the well bore section is shielded from fracturing.

22. A method of allowing multiple distinct fractures to be formed in a subterranean formation from a non-vertical open hole section of a well bore, the method comprising:

inserting a tubing into the well bore;

providing a coating-forming solution through the tubing into the well bore;

allowing the coating-forming solution to form a substantially impermeable coating on the wall of the well bore throughout the section of the well bore from which the fractures will be initiated;

providing a coating remover through the tubing to a desired first fracture initiation location in the well bore to remove the coating at that location sufficient to allow a first fracture to be formed in the subterranean formation therefrom;

fracturing the subterranean formation in the vicinity of the first fracture initiation location;

placing a non-damaging proppant plug across the first fracture initiation location and along a portion of the well bore adjacent thereto to isolate the first fracture from any subsequent fracturing operations;

moving the tubing to a desired second fracture initiation location;

providing a coating remover through the tubing to the second fracture initiation location in the well bore to remove the coating at that location sufficient to allow a second fracture to be formed in the subterranean formation therefrom; and fracturing the subterranean formation in the vicinity of the second fracture initiation location.

23. The method of claim 22, further including providing a first plug in the well bore around the first fracture and first fracture initiation location after fracturing the subterranean formation in the vicinity of the first fracture initiation location, and providing a second plug in the well bore around the second fracture and second fracture initiation location after fracturing the subterranean formation in the vicinity of the second fracture initiation location.

24. The method of claim 23, further including removing the first and second plugs and remaining coating from the wall of the well bore section after all fractures have been formed in the subterranean formation therefrom.

* * * * *